US007242901B2

(12) United States Patent
Oya et al.

(10) Patent No.: US 7,242,901 B2
(45) Date of Patent: Jul. 10, 2007

(54) DOCUMENT IMAGE SCANNING DEVICE

(75) Inventors: Kazuyuki Oya, Kyoto (JP); Yoshitaka Nose, Kyoto (JP)

(73) Assignee: Murata Kikai Kabushiki Kaisha, Tokyo (JP)

( * ) Notice: Subject to any disclaimer, the term of this patent is extended or adjusted under 35 U.S.C. 154(b) by 281 days.

(21) Appl. No.: 11/033,200

(22) Filed: Jan. 11, 2005

(65) Prior Publication Data

US 2005/0158091 A1 Jul. 21, 2005

(30) Foreign Application Priority Data

Jan. 20, 2004 (JP) ..... 2004-011821

(51) Int. Cl.
*G03G 11/00* (2006.01)

(52) U.S. Cl. ..... 399/374; 271/3.14

(58) Field of Classification Search ..... None
See application file for complete search history.

(56) References Cited

U.S. PATENT DOCUMENTS 5,482,265 A * 1/1996 Nakazato et al. ..... 271/242
5,743,518 A * 4/1998 Takashimizu et al. ..... 271/4.1
5,934,661 A * 8/1999 Kameyama ..... 271/4.08
7,130,077 B2 * 10/2006 Takahashi et al. ..... 358/1.9

FOREIGN PATENT DOCUMENTS

| | | |
|---|---|---|
| JP | 08-069137 | 3/1996 |
| JP | 08-133551 | 5/1996 |
| JP | 2001-130770 | 5/2001 |
| JP | 2003-309703 | 10/2003 |

* cited by examiner

*Primary Examiner*—Daniel J. Colilia
*Assistant Examiner*—N. Ha
(74) *Attorney, Agent, or Firm*—Hogan & Hartson LLP

(57) ABSTRACT

A document image scanning device includes two scanning units provided along a document transportation path for scanning both sides of an original document. A plurality of transportation systems are classified into a first transportation system upstream of a first scanning unit and a second transportation system located front and back of first and second scanning units. The first and the second transportation systems are driven by first and second drive transmitting units, respectively. The first and the second drive transmitting units are distributed from an output shaft of one motor to transmit a driving force.

13 Claims, 4 Drawing Sheets

DOCUMENT IMAGE SCANNING DEVICE

BACKGROUND OF THE INVENTION

1. Field of the Invention

The present invention relates to a document image scanning device which scans an image on both sides of an original document while transporting the original document by an Automatic Document Feeder (ADF) which operates by one motor in an image forming device such as a facsimile machine and a copying machine (including a Multi-Function Peripheral (MFP) of these machines).

2. Description of Related Art

In general, an electrophotographic copying machine and a facsimile machine include an ADF which separates original documents set on a document tray one sheet at a time and feeds each original document toward a scanning unit. In such an ADF, a separating roller and a plurality of transportation rollers are disposed along a document transportation path. The separating roller separates and feeds the original documents fed from the document tray one sheet at a time. The transportation rollers are provided downstream of the separating roller. The transportation rollers transport the original documents toward the scanning unit and discharge the original documents that passed the scanning unit onto a discharge tray. In a known duplex scanning device, two scanning units are provided along a document transportation path. The known duplex scanning device scans an image on both sides (a first side and a second side) of an original document by transporting the original document once through the document transportation path. To downsize such a duplex scanning device, the document transportation path is formed in a sideways letter-U shape so that a discharge tray is located below a document tray. The original document is guided in a U-turn manner from the document tray to the discharge tray. In such a scanning device having the U-turn shaped document transportation path, each of the rollers is provided in proximity to one another. Therefore, without using a large-scaled drive transmitting mechanism, the rollers can be driven by one motor.

As described above, in a general document image scanning device, the scanning unit is provided along the transportation path. A driving force is transmitted from one motor to transportation systems from a picking up of an original document via the scanning unit to a discharging of the original document. In such a document image scanning device, a drive transmitting system of the transportation system of the original document leading to the scanning unit and a drive transmitting system of the transportation system at front and back of the scanning unit may be linked to one another by the same system. If the drive transmitting systems are linked to one another, while the original document passes the scanning unit, a vibration based on a fluctuation of a transportation load or a backlash of a gear or the like of the transportation system upstream of the scanning unit is transmitted to the transportation system of the scanning unit via the drive transmitting system such as a gear and a belt. The fluctuation of the transportation load and the vibration influence an image scanning process and cause a distortion of a scanned image.

In a first conventional document image scanning device, a distance from a document separator to a scanning unit is at least one half the length of a maximum original document (in case the maximum original document is A3 sized paper, 210 mm or longer) so that the size of each original document can be detected before a scanning process even when original documents of various sizes are placed on a document tray. Even in such a document image scanning device, at an instant when a trailing edge of a long original document such as an A3 size or a B4 size original document departs from the document separator, a transportation load vanishes. Accordingly, the transportation system of the scanning unit is influenced. In particular, in case two scanning units are disposed along the transportation path, a fluctuation of the transportation load becomes large at a second scanning unit. In case of an original document being smaller than a landscape A4 size original document, at an instant when the trailing edge of the original document departs from the document separator and a next original document is fed into the document separator, the fluctuation of the load is generated in the same manner. The fluctuation is transmitted to the transportation system of the scanning units. In consideration of the above-described drawbacks, a second conventional document image scanning device divides the transportation system from the picking up of the original document via the scanning unit to the discharging of the original document into two transportation systems. One transportation system leads to the proximity of the scanning unit. Another transportation system includes transportation at the front and back of the scanning unit and the discharging of the original document. The two transportation systems are driven via two drive transmitting systems. The two drive transmitting systems are distributed at an output shaft of a motor.

In the second conventional document image scanning device, the two drive transmitting systems are distributed at the output shaft of the motor. Therefore, the fluctuation of the transportation load and the vibration or the like of the transportation system leading to the proximity of the scanning unit do not influence the transportation system at the front and the back of the scanning unit. As a result, the scanned image is not distorted as described above and an image with a high image quality can be formed. However, in the second conventional document image scanning device, the scanning units are not provided at two positions along the transportation path so as to scan an image on both sides of the original document by transporting the original document once through the transportation path. In addition, the second conventional document image scanning device does not consider the influence of the fluctuation of the transportation load in the transportation system of the original document at the image scanning unit for scanning an image on a second side of the original document.

SUMMARY OF THE INVENTION

The present invention has been made in consideration of the above-described circumstances. An advantage of the present invention is to provide a document image scanning device for scanning an image on both sides of an original document by transporting the original document once, which can eliminate a fluctuation of a transportation load at a scanning unit resulting from an influence of a transportation system and which can form a high-quality image without a distortion.

According to a first aspect of the present invention, a document image scanning device includes a document pickup unit, a separating and feeding unit, a plurality of transportation units, a first scanning unit and a second scanning unit. The document pickup unit picks up an original document from a document placing part. The separating and feeding unit separates and feeds picked up original documents one sheet at a time. The transportation units are provided to transport each separated and fed original document along a transportation path leading to a discharge tray. The first scanning unit scans an image on a first side of the original document transported through the transportation path. The second scanning unit scans an image on a second side of the original document after the first scanning unit. The plurality of the transportation units are classified into a first transportation system and a second transportation system. The first transportation system includes the picking up and the feeding of the original document at upstream of the first scanning unit. The second transportation system is located at front and back of the first and the second scanning units. The first and the second transportation systems are driven by a first and a second drive transmitting units, respectively. The first and the second drive transmitting units are distributed from an output shaft of one motor to transmit a driving force.

According to a second aspect of the present invention, the driving force from the output shaft is preferable to be diverged and transmitted by an engagement of gears. According to a third aspect of the present invention, the first scanning unit is preferable to be a movable scanner device and capable of being under a standstill standby state at a prescribed position on the transportation path at a side for scanning the first side of the transported original document. Meanwhile, the second scanning unit is preferable to be a contact image sensor and located at a prescribed position on the transportation path at a side for scanning the second side of the transported original document.

According to the aspects of the present invention, in the document image scanning device, the first transportation system including the picking up and the feeding of the original document and the second transportation system at the front and the back of the first and the second scanning units are classified into separate systems from one another. The first and the second transportation systems are respectively driven by the first and the second drive transmitting units, which are distributed from the output shaft of one motor to transmit the driving force. Therefore, the second transportation system is not influenced by the fluctuation of the transportation load of the first transportation system. As a result, an image scanned by the first and the second scanning units is not distorted. In particular, since the distance from the separating and feeding unit to the second scanning unit is long, if all of the transportation systems including the document transportation system at the front and the back of the second scanning unit are driven collectively by the drive transmitting systems, the fluctuation of the transportation load when the trailing edge of the original document departs from the separating and feeding unit and a next original document is fed in greatly influences the second scanning unit. However, in the present invention, the transportation system at the front and the back of the scanning units and the other transportation system located at the upstream are divided substantially from one another. Therefore, the above-mentioned influence by the fluctuation of the transportation load can be avoided.

DETAILED DESCRIPTION OF THE INVENTION

Figure 1:
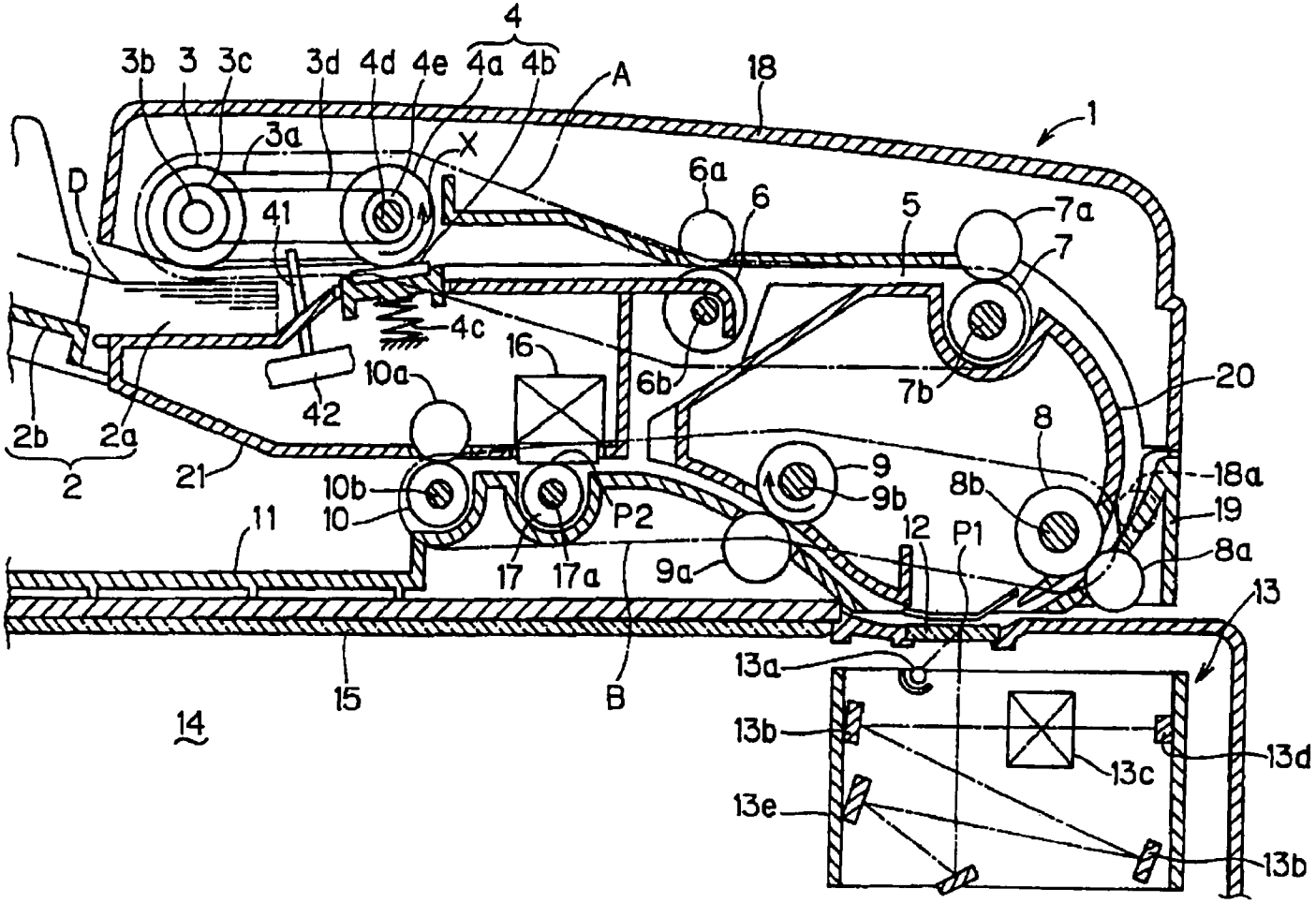
FIG. 1 is a lateral cross-sectional view showing an example of a document image scanning device according to an embodiment of the present invention.

Embodiments of the present invention will be described with reference to the drawings. FIG. 1 is a lateral cross-sectional view of the principal parts of a document image scanning device 1 having an ADF in a facsimile machine, a copying machine or a MFP having both a facsimile function and a copying function (also including a printer function). The document image scanning device 1 shown in FIG. 1 is formed as a duplex document image scanning device. While transporting original documents D one sheet at a time, the document image scanning device 1 scans an image on both sides of an original document D and outputs a digital signal. Further, in FIG. 1, an inner side of the page is a front side of the document image scanning device 1 and a front side of the page is a rear side of the document image scanning device 1.

At a document feeding opening 2*a* of the document image scanning device 1, a document tray 2*b* is set removably and provided slanting downward toward the document feeding opening 2*a*. The document feeding opening 2*a* and the document tray 2*b* constitute a document placing part 2. A pickup roller (a document pickup unit) 3 is provided above the document feeding opening 2*a*. The pickup roller 3 picks up from an uppermost layer, the original documents D stacked facing upward in an order of pages on the document placing part 2. Subsequent to the pickup roller 3, a document separating device (a separating and feeding unit) 4 is provided for separating and feeding the picked up original documents D one sheet at a time. The document separating device 4 includes a separating roller 4*a* and a separating pad 4*b*. The separating pad 4*b* is urged to contact elastically against a periphery of the separating roller 4*a*. The original documents D picked up by the pickup roller 3 are introduced to the separating roller 4*a* and the separating pad 4*b*. By a difference between coefficients of friction of the separating roller 4*a* and the separating pad 4*b* with respect to the original documents D accompanying a rotation of the separating roller 4*a*, the original documents D are separated one sheet at a time and fed in a downstream direction. A compression spring 4*c* functions to elastically contact the separating pad 4*b* against the periphery of the separating roller 4*a*. Further, the document separating device 4 can also be a separating roller and a retard roller.

The original document D fed from the document separating device 4 is resisted and transported by a resist roller 6, a first transportation roller 7 and a second transportation roller 8 which are provided sequentially along a U-turn shaped document transportation path 5. Then, the original document D reaches a first scanning point P1. The original document D is further transported to a second scanning point P2 by a third transportation roller 9 and discharged onto a discharge tray 11 by a discharge roller 10. A platen 12 is provided at a first scanning position P1. When the original document D passes over the platen 12, image information on a front side (first side) of the original document D is scanned sequentially by a scanner device (first scanner) 13 on standby below the platen 12. The scanned image information is output as a digital signal as mentioned above.

The scanner device 13 includes a light source 13*a* which consists of a fluorescent light or a cold-cathode tube, a plurality of mirrors 13*b*, a focusing lens 13*c* and a Charge Coupled Device (CCD) 13*d*. The light source 13*a*, the mirrors 13*b*, the focusing lens 13*c* and the CCD 13*d* are unitized and loaded on a carriage 13*e*. An irradiated light from the light source 13*a* is reflected by the original document D passing the scanning point P1 on the platen 12. Then, the irradiated light is reflected repeatedly by four mirrors 13*b*, focused by the focusing lens 13*c* and enters into the CCD 13*d* (refer to a light path shown with dashed lines). In the CCD 13*d*, the image information on the front side of the original document D is converted into an electric signal and output as a digital signal.

As a movable scanner device, the scanner device 13 also functions as a Flat Bed Scanner (FBS). That is, although the drawing is partially omitted, a FBS 14 continues at the left of a fractured part of FIG. 1. In FIG. 1, the carriage 13*e* is on standby and standstill at a scanning position of an ADF original document. When scanning a FBS original document, the scanner device 13 moves inside the FBS 14 and reciprocates along a lower surface of a platen glass 15 inside the FBS 14. While reciprocating, the scanner device 13 scans the image information of the original document placed on the platen glass 15 in the same manner. The document image scanning device 1, the document tray 2*b* and the discharge tray 11 are formed integrally to constitute a platen cover. The platen cover can be opened and closed vertically with a front side of the page of FIG. 1 as a hinge (not shown). When scanning an original document by the FBS 14, the platen cover is opened and the original document is placed on the exposed platen glass 15.

As described above, the original document which the image on the front side has been scanned at the first scanning point P1 is transported further by the third transportation roller 9 and reaches the second scanning point P2. The second scanning point P2 is a contact point of a contact image sensor (second scanner) 16 and a platen roller 17. The contact image sensor 16 is disposed to scan a reverse side of the transported original document. The platen roller 17 is disposed so as to make contact with the contact image sensor 16. The original document introduced between the contact image sensor 16 and the platen roller 17 is fed while being slid against a scanning surface of the contact image sensor 16 by a rotation of the platen roller 17. An image on the reverse side (second side) of the original document is scanned by the contact image sensor 16, converted into an electric signal and output as a digital signal.

The separating roller 4*a* (including the pickup roller 3), the resist roller 6 and the first transportation roller 7 constitute a first transportation system A. The second transportation roller 8, the third transportation roller 9, the platen roller 17 and the discharge roller 10 constitute a second transportation system B. The transportation systems A and B classified into two systems have one motor 22 (refer to FIGS. 2 and 3) as a drive source. A driving force is transmitted individually to the transportation systems A and B via drive transmitting systems A1 and B1 to be described later, respectively.

The pickup roller 3 is formed so that a driving force is transmitted from a drive shaft 4*d* of the separating roller 4*a*. Roughly describing, a frame 3*a* is attached on the drive shaft 4*d* via a torque limiter (not shown) in a manner capable of being swung vertically. At a tip end of the frame 3*a*, a supporting shaft 3*b* is supported rotatably. A belt 3*d* is provided in a tensioned state between a pulley 4*e* attached on the drive shaft 4*d* and a pulley 3*c* attached on the supporting shaft 3*b*. The rotation of the drive shaft 4*d* is transmitted via the pulley 4*e*, the belt 3*d* and the pulley 3*c* to the supporting shaft 3*b*. Furthermore, the rotation of the supporting shaft 3*b* is transmitted via a one-way clutch (not shown) to the pickup roller 3.

Under a standby state, the pickup roller 3 is located at an upper position by the frame 3*a*. When the drive shaft 4*d* rotates forward (in a direction X), the frame 3*a* swings downward with the drive shaft 4*d* as a center by an action of the torque limiter. The frame 3*a* stops swinging when the pickup roller 3 makes contact with the uppermost layer of the original documents D stacked on the document placing part 2. By the continuous rotation of the drive shaft 4*d*, the pickup roller 3 rotates via the transmitting system (the pulley 4*e*, the belt 3*d* and the pulley 3*c*). As described above, while the drive shaft 4*d* is rotating forward, the pickup roller 3 rotates while making contact with the uppermost layer of the original documents D. Therefore, the original documents D are fed sequentially from the uppermost layer. When the drive shaft 4*d* stops once and rotates backward (in an opposite direction of the direction X), the frame 3*a* swings upward by the action of the torque limiter. Then, when the drive shaft 4*d* stops, the frame 3*a* is maintained under a standstill standby state.

A driving force is transmitted from the drive shaft 4*d* via a one-way clutch (not shown) to the separating roller 4*a*. Therefore, by the forward rotation of the drive shaft 4*d*, as described above, the original documents D are picked up by the pickup roller 3. The picked up original documents D are introduced to the separating roller 4*a* and the separating pad 4*b*. The original documents D are separated one sheet at a time as described above and fed toward a downstream direction. Each of the original documents D fed from the separating roller 4*a* is resisted by the resist roller 6 and transported further to the downstream side. Peripheral speeds of each of the rollers 7, 8, 9, 17 and 10 located downstream of the resist roller 6 are faster than peripheral speeds of the separating roller 4*a* and the pickup roller 3. A page interval of the original documents is maintained by the separating roller 4*a* and the resist roller 6. Therefore, when a leading edge of the original document D fed by the separating roller 4*a* reaches the resist roller 6, a transportation load (tension force) works on the original document by a difference in the peripheral speeds. However, as described above, the one-way clutch (not shown) is embedded in the separating roller 4*a* and the pickup roller 3. Both of the rollers 4*a* and 3 idle by the one-way clutch and the transportation load is relieved.

Pressure rollers 6*a*, 7*a*, 8*a*, 9*a* and 10*a* are provided facing the resist roller 6, the first through the third transportation rollers 7, 8 and 9 and the discharge roller 10, respectively. The original document is nipped by these rollers and transported. The separating roller 4*a*, the pickup roller 3 and the pressure rollers 6*a* and 7*a* are provided at an inner side of a jam access cover 18. The jam access cover 18 is provided in a manner capable of being opened and closed vertically with a hinge pin 18*a* as a center. Therefore, when the original document is jammed in the document transportation path 5 upstream of the second transportation roller 8, by opening the jam access cover 18, the separating pad 4*b*, the resist roller 6 and the first transportation roller 7 are exposed. Therefore, the jammed original document can be removed easily.

The second transportation roller 8, the third transportation roller 9, the pressure roller 8*a* and 9*a*, the platen roller 17 and the discharge roller 10 are mounted on a device frame 19 and a tubular intermediate inner guide frame 20. The device frame 19 constitutes a frame of the platen cover including the ADF. The intermediate inner guide frame 20 is fixed on the device frame 19. Furthermore, the contact image sensor 16 and the pressure roller 10*a* are mounted on an intermediate frame 21 which can be opened and closed vertically with a drive shaft 6*b* of the resist roller 6 as a center. A removal of a jammed original document between the second transportation roller 8 and the third transportation roller 9 will be described later. In case an original document is jammed downstream of the third transportation roller 9, by opening the jam access cover 18 and then opening the intermediate frame 21, nipped states between the contact image sensor 16 and the platen roller 17 and between the discharge roller 10 and the pressure roller 10*a* are released. Accordingly, an original document jammed in this area can be removed easily.

Figure 2:
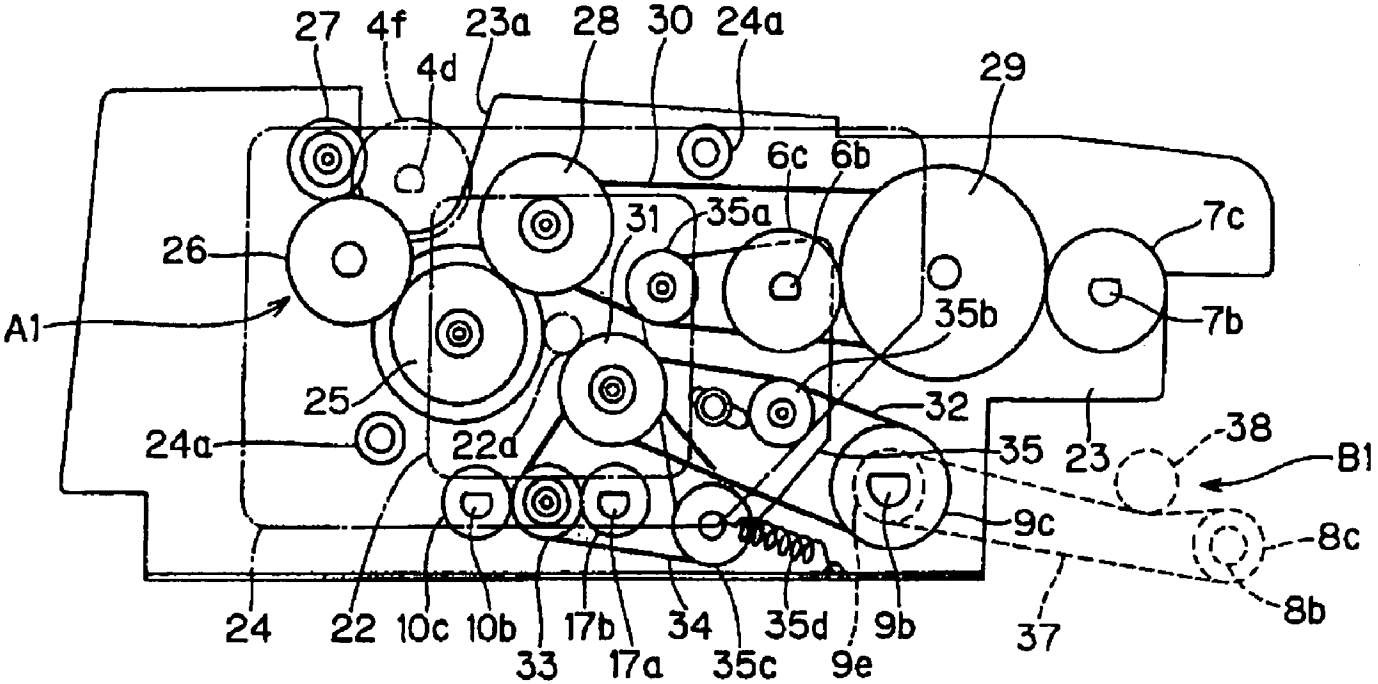
FIG. 2 is a front view showing drive transmitting mechanisms of each roller.
Figure 3:
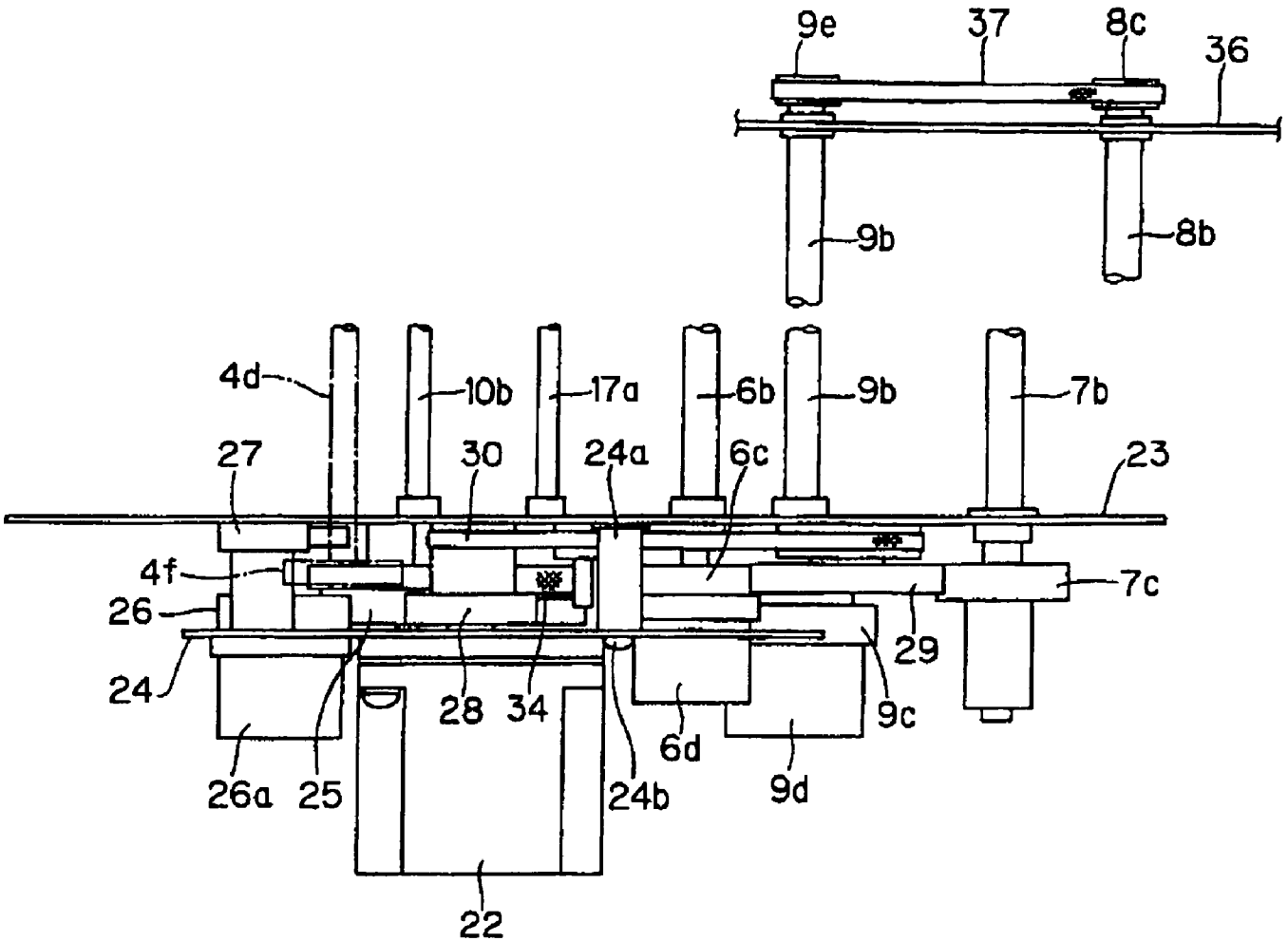
FIG. 3 is a plan view of FIG. 2.

FIGS. 2 and 3 show drive transmitting mechanisms of each of the above-described rollers. FIG. 2 is a front view (when viewing from the entire document image scanning device 1, a rear view). FIG. 3 is a plan view. A sheet-metal frame (rear frame) 23 for the drive transmitting mechanism is fixed on the device frame 19. One end part of the drive shafts 6*b*, 7*b*, 9*b*, 17*a* and 10*b* of the resist roller 6, the first transportation roller 7, the second transportation roller 9, the platen roller 17 and the discharge roller 10 are supported on the frame 23. A sheet-metal motor bracket 24 is screwed with a screw 24*b* onto a nut column 24*a* fixed on the frame 23. Accordingly, the motor bracket 24 is fixed onto the frame 23 with a prescribed interval spaced from the frame 23. A motor 22 is mounted on the motor bracket 24. The motor 22 is a common drive source for each of the rollers.

Gears 6*c*, 7*c*, 9*c*, 17*b* and 10*c* are mounted on an end part of the drive shafts 6*b*, 7*b*, 9*b*, 17*a* and 10*b* of each of the rollers. A driving force is transmitted from an output gear (output shaft) 22*a* of the motor 22 via an idler gear or a belt or the like to each of the gears. That is, a large diameter gear of a two-staged first idler gear 25 engages with the output gear 22*a*. A second idler gear 26 engages with a small diameter gear of the first idler gear 25. A third idler gear 27 engages with the second idler gear 26. A drive transmitting system for the separating roller 4*a* is established by these engagements. That is, a cutout 23*a* is formed on an upper side of the frame 23. When the jam access cover 18 is closed, the drive shaft 4*d* of the separating roller 4*a* is fit and held in the cutout 23*a*. A gear 4*f* mounted on one end of the drive shaft 4*d* engages with the third idler gear 27. A rotational driving force is transmitted from the output gear 22*a* of the motor 22 via the first idler gear 25, the second idler gear 26 and the third idler gear 27 to the separating roller 4*a*.

A fourth idler gear 28 engages with the first idler gear 25. A first timing belt (a toothed belt, same as above) 30 is provided in a tensioned state between the fourth idler gear 28 and a fifth idler gear 29. The gear 6*c* of the resist roller 6 and the gear 7*c* of the first transportation roller 7 engage with the fifth idler gear 29. Accordingly, a dive transmitting system of the resist roller 6 and the first transportation roller 7 is established. A rotational force is transmitted from the output gear 22*a* of the motor 22 to the resist roller 6 and the first transportation roller 7.

A sixth idler gear 31 also engages with the output gear 22*a*. A second timing belt 32 is provided in a tensioned state between the sixth idler gear 31 and the gear 9*c* of the third transportation roller 9. Accordingly, a rotational force is transmitted from the output gear 22*a* via the sixth idler gear 31 and the second timing belt 32 to the third transportation roller 9. From the drive shaft 9*b* of the third transportation roller 9, as to be described later, a driving force is transmitted to the gear 8*c* of the second transportation roller 8 via the gear 9*e* and the fourth timing belt 37 provided at a front frame 36 (refer to FIGS. 3 and 4). A third timing belt 34 is provided in a tensioned state between the sixth idler gear 31 and a seventh idler gear 33. The gear 17*b* of the platen roller 17 and the gear 10*c* of the discharge roller 10 engage with the seventh idler gear 33. Accordingly, a rotational driving force is transmitted from the output gear 22*a* via the sixth idler gear 31, the third timing belt 34 and the seventh idler gear 33 to the platen roller 17 and the discharge roller 10.

As described above, the drive transmitting system from the first idler gear 25 via the second idler gear 26 to the third idler gear 27 and the drive transmitting system from the first idler gear 25 via the fourth idler gear 28, the first timing belt 30 and the fifth idler gear 29 to the gear 6*c* or the gear 7*c* constitute the first drive transmitting system A1 for driving the first transportation system A, which includes the separating roller 4*a* (including the pickup roller 3), the resist roller 6 and the first transportation roller 7. The drive transmitting system from the sixth idler gear 31 via the second timing belt 32 to the gear 9*c* and the gear 8*c* and the drive transmitting system from the sixth idler gear 31 via the third timing belt 34 to the gear 17*b* or the gear 10*c* constitute the second drive transmitting system B1 for driving the second transportation system B, which includes the second transportation roller 8, the third transportation roller 9, the platen roller 17 and the discharge roller 10.

Many of the first through the seventh idler gears 25, 26, 27, 28, 29, 31 and 33 are formed of a multi-staged gear. A diameter (a number of gear teeth) of each of the gears is set appropriately so that each of the rollers rotates at a prescribed peripheral speed. Each of the idler gears is set rotatably on gear studs fixed on the frame 23 by a caulk or the like. Another end of a part of the gear studs is held on the motor bracket 24. Electromagnetic clutches 26*a*, 6*d* and 9*d* are respectively provided on the second idler gear 26, the gear 6*c* of the resist roller 6 and the gear 9*c* of the third transportation roller 9 in the drive transmitting system to the separating roller 4*a*. The separating roller 4*a*, the resist roller 6 and the third transportation roller 9 are controlled individually. Further, these electromagnetic clutches are not shown in FIG. 2.

In FIG. 2, tension gears 35*a*, 35*b* and 35*c* function to adjust tension of the first, the second and the third timing belts 30, 32 and 34, respectively. The tension gears 35*a*, 35*b* and 35*c* are provided on a tension plate 35. The tension plate 35 is provided in a manner capable of being swung within a vertical surface area with the drive shaft 6*b* of the resist roller 6 as a center. The tension plate 35 is urged elastically by a tension spring 35*d* in a counterclockwise direction with the drive shaft 6*b* as a center at all times. Accordingly, each of the tension gears 35*a*, 35*b* and 35*c* acts upon the first, the second and the third timing belts 30, 32 and 34, respectively to maintain the tensioned state at all times.

Figure 4:
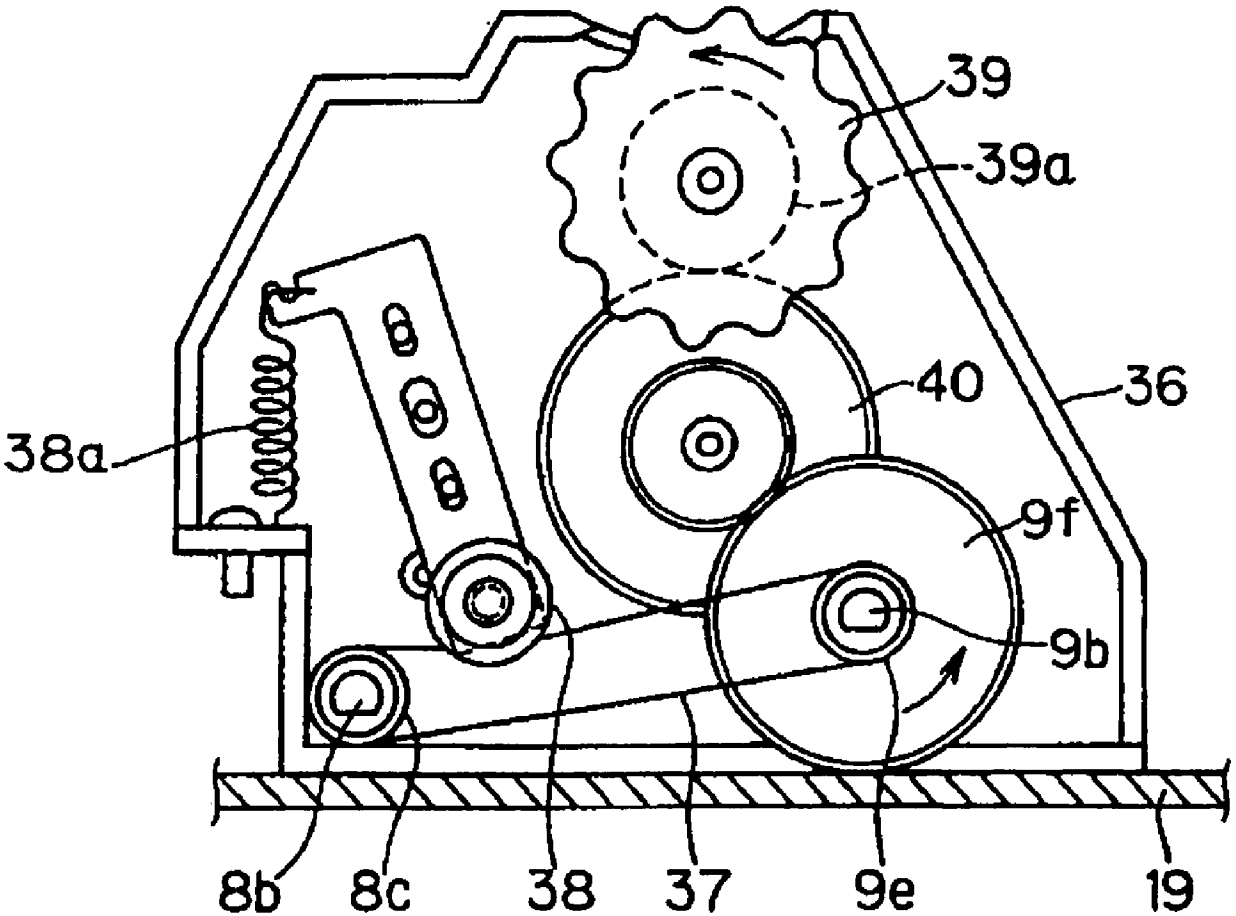
FIG. 4 is a front view showing a part of the drive transmitting mechanisms.

Next, the drive transmitting mechanism to the second transportation roller 8 will be described. This drive transmitting mechanism is formed at another end (the front side of the document image scanning device 1) of the drive shaft 9*b* of the third transportation roller 9. That is, FIG. 4 is a front view of the drive transmitting mechanism viewed from the front side of the document image scanning device 1. The drive shaft 9*b* of the third transportation roller 9 extends to the front side by crossing the document image scanning device 1. A front end part of the drive shaft 9*b* is held rotatably on the front frame 36 mounted on the device frame 19. A front end part of the drive shaft 8*b* of the second transportation roller 8 is also held on the front frame 36. The gears 9*e* and 8*c* are mounted on the front end part of the drive shafts 9*b* and 8*b*, respectively. A fourth timing belt 37 is provided in a tensioned state on both of the gears 9*e* and 8*c*. Accordingly, the drive transmitting mechanism to the second transportation roller 8 is established. Therefore, when the third transportation roller 9 is driven and rotated via the drive transmitting mechanism, the second transportation roller 8 is also driven and rotated at the same time by the drive transmitting mechanism.

As shown in FIG. 4, the tension pulley 38 acts upon the fourth timing belt 37 by an elastic urging force of the tension spring 38*a* and maintains the fourth timing belt 37 under a tensioned state at all times. A jam removal operation knob 39 is formed so that a part of the operation knob 39 is exposed to an upper surface of the image forming device 1 when the jam access cover 18 is opened. When an original document is jammed at the second transportation roller 8 and the third transportation roller 9, the jam access cover 18 is opened. Then, the exposed part of the operation knob 39 is rotated to forcibly rotate the second transportation roller 8 and the third transportation roller 9. Accordingly, the jammed original document can be removed. A large diameter gear 9*f* is mounted on the drive shaft 9*b* of the third transportation roller 9. A two-staged idler gear 40 is engaged between the gear 9*f* and a gear 39*a* of the operation knob 39.

A one-way clutch (not shown) such as a ratchet mechanism is embedded in the idler gear 40. When the operation knob 39 is rotated in a direction shown with an arrow, by a lock function of the one-way clutch, the rotation of the operation knob 39 is transmitted to the third transportation roller 9 via the idler gear 40 and the gear 9*f*. Furthermore, the rotation of the third transportation roller 9 is transmitted to the second transportation roller 8. By the rotation of the operation knob 39, the third transportation roller 9 and the second transportation roller 8 are rotated forcibly and the original document jammed in this area is fed. As a result, the jammed original document can be removed.

Further, as described above, the electromagnetic clutch 9*d* is mounted on the drive shaft 9*b* of the third transportation roller 9. When the electromagnetic clutch 9*d* is disengaged, the third transportation roller 9 is shut from the drive transmitting system. Therefore, the load of the third transportation roller 9 does not work against the operation of the operation knob 39. Meanwhile, when the third transportation roller 9 receives the driving force of the drive motor 22 and rotates regularly as shown with an arrow (in a document transportation direction), the one-way clutch is unlocked and the rotational force of the third transportation roller 9 is not transmitted to the operation knob 39.

As described above, the document transportation system of the document image scanning device 1 is classified into two transportation systems, i.e. the first transportation system A and the second transportation system B. The first transportation system A includes the rollers located upstream of the first scanning unit (the first scanning point P1). The second transportation system B is located to the front and back of the scanning units (the first and the second scanning points P1 and P2) and includes each of the rollers leading to the discharge roller 10. The two transportation systems A and B are driven and rotated via the drive transmitting systems A1 and B1, respectively. The drive transmitting systems A1 and B1 are distributed from the output shaft 22*a* of the motor 22 to transmit the driving force individually. Therefore, the fluctuation of the transportation load and the vibration based on the backlash of the gear or the like during the transportation of the original document by the first transportation system A are not transmitted to the second transportation system B via the drive transmitting systems A1 and B1. Each of the rollers of the second transportation system B rotates normally without receiving an influence of the fluctuation of the transportation load in the first transportation system A. A distortion of the image scanned by each of the scanning units can be reduced considerably. In particular, even in case the length of the transportation path to the scanning point P1 is set one half of the length of the maximum original document or longer so that a size of each original document can be detected before the scanning process even when original documents of different sizes are placed on the document tray 2*b*, there is no influence of the fluctuation of the transportation load at an instant when a trailing edge of a long original document departs from the document separating device 4. While an original document is passing the second scanning point P2 located away from the document separating device 4, even when a next original document is fed to the document separating device 4, the fluctuation of the transportation load does not influence the scanning process at the second scanning point P2.

The transportation system from the first transportation system to the second transportation system B is curved in a U-turn shape. Each of the rollers of the transportation systems is disposed along the curved transportation path and has one motor 22 as the drive source. The contact image sensor 16 as the second scanning unit is provided in a curved space. Therefore, while maintaining an image quality of the scanned image, the document image scanning device 1 can be downsized. Since the movable scanner device 13 is adopted as the first scanning unit, the first scanning unit can also function as an FBS. Therefore, while downsizing the document image scanning device 1, various image scanning processes can be carried out.

In FIG. 1, a shutter 41 for aligning leading edges of the original documents D is provided between the pickup roller 3 and the separating roller 4 in a manner capable of protruding and receding with respect to the document placing part 2. Under a standby state, the shutter 41 protrudes onto the document placing part 2 and functions to align the leading edges of the original documents D set on the document tray 2*b*. The shutter 41 is provided on a link mechanism 42 (drawing is partially omitted) which swings vertically in response to the rotation of the resist roller 6. By the vertical swing of the link mechanism 42, the shutter 41 protrudes and recedes with respect to the document placing part 2. As described above, since the shutter 41 is provided to protrude and recede with respect to the document placing part 2 in response to the resist roller 6 mechanically, without using an expensive electric component such as a solenoid, an operation mechanism of the shutter 41 can be simplified.

Further, in the above-described embodiment, the first scanning unit is the movable scanner device and the second scanning unit is the contact image sensor. However, the first scanning unit can be a contact image sensor and the second scanning unit can be a movable scanner device. In place of the movable scanner device, a contact image sensor or other fixed type scanner devices can be adopted.

The invention claimed is:

1. A document image scanning device, comprising:

means for picking up an original document from a document placing part;

means for separating and feeding the picked up original document one sheet at a time;

a plurality of means for transporting the separated and fed original document along a transportation path to a discharge tray;

a first scanning means for scanning an image on a first side of the original document transported along the transportation path, wherein the first scanning means is a movable scanner device and provided under a standstill standby state at a prescribed position on the transportation path for scanning the first side of the transported original document; and a second scanning means for scanning an image on a second side of the original document after the first scanning means, wherein the second scanning means is a contact image sensor and provided at a prescribed position on the transportation path for scanning the second side of the transported original document;

wherein the plurality of means for transporting are classified into a first transportation system and a second transportation system, the first transportation system includes a picking up and a feeding of the original document upstream of the first scanning means, and the second transportation system is located front and back of the first and the second scanning means; and the first and the second transportation systems are respectively driven by a first and a second drive transmitting means, and the first and the second drive transmitting means are distributed from an output shaft of one motor to transmit a driving force.

2. The document image scanning device according to claim 1, wherein the driving force is transmitted from the output shaft by an engagement of gears.

3. The document image scanning device according to claim 1, wherein the means for picking up an original document includes a pick up roller.

4. The document image scanning device according to claim 1, wherein the means for separating and feeding includes a separating roller, a separating pad and a transportation roller.

5. The document image scanning device according to claim 1, wherein the first scanning means includes a light source.

6. The document image scanning device according to claim 1, wherein the first scanning means functions as a flat bed scanner.

7. The document image scanning device according to claim 1, wherein the first transportation system includes a resist roller, a separating roller and a transportation roller.

8. A document image scanning device, comprising:

a picking up unit that picks up an original document from a document placing part;

a separating and feeding unit that separates and feeds the picked up original document one sheet at a time;

a plurality of transportation systems that transport the separated and fed original document along a transportation path to a discharge tray;

a first scanning unit that scans an image on a first side of the original document transported along the transportation path, wherein the first scanning unit is a movable scanner device and provided under a standstill standby state at a prescribed position on the transportation path for scanning the first side of the transported original document; and a second scanning unit that scans an image on a second side of the original document after the first scanning unit, wherein the second scanning unit is a contact image sensor and provided at a prescribed position on the transportation path for scanning the second side of the transported original document;

wherein the plurality of transportation systems are classified into a first transportation system and a second transportation system, the first transportation system includes a picking up and a feeding of the original document upstream of the first scanning unit, and the second transportation system is located front and back of the first and the second scanning units; and the first and the second transportation systems are respectively driven by a first and a second drive transmitting unit, and the first and the second drive transmitting units are distributed from an output shaft of one motor to transmit a driving force.

9. The document image scanning device according to claim 8, wherein the driving force is transmitted from the output shaft by an engagement of gears.

10. The document image scanning device according to claim 8, wherein the picking up unit includes a pick up roller.

11. The document image scanning device according to claim 8, wherein the separating and feeding unit includes a separating roller, a separating pad and a transportation roller.

12. The document image scanning device according to claim 8, wherein the first scanning unit includes a light source.

13. The document image scanning device according to claim 8, wherein the first scanning unit functions as a flat bed scanner.

* * * * *